US009022681B1

(12) United States Patent
Rodenbeck et al.

(10) Patent No.: US 9,022,681 B1
(45) Date of Patent: May 5, 2015

(54) NOTE TOTE SYSTEM

(71) Applicants: Susan L. Rodenbeck, Palm Harbor, FL (US); Ab Mobasher, Tigard, OR (US)

(72) Inventors: Susan L. Rodenbeck, Palm Harbor, FL (US); Ab Mobasher, Tigard, OR (US)

( * ) Notice: Subject to any disclaimer, the term of this patent is extended or adjusted under 35 U.S.C. 154(b) by 372 days.

(21) Appl. No.: 13/661,582

(22) Filed: Oct. 26, 2012

Related U.S. Application Data

(60) Provisional application No. 61/563,036, filed on Nov. 23, 2011.

(51) Int. Cl.

| | |
|---|---|
| ***B42F 1/02*** | (2006.01) |
| ***B42F 1/10*** | (2006.01) |
| ***B42F 7/04*** | (2006.01) |
| ***B42F 13/12*** | (2006.01) |

(52) U.S. Cl.
CPC ..... *B42F 13/12* (2013.01)

(58) Field of Classification Search
CPC ..... B42F 1/02; B42F 1/10; B42F 7/04
USPC ..... 24/67 R, 67.3, 498
See application file for complete search history.

(56) References Cited

U.S. PATENT DOCUMENTS 857,488 A * 6/1907 Rosenthal ..... 24/67 R
2,856,660 A * 10/1958 Twohig ..... 402/44

FOREIGN PATENT DOCUMENTS

EP 1870251 * 12/2007

* cited by examiner

*Primary Examiner* — Kyle Grabowski

(57) ABSTRACT

First and second plates have a space between them. Each plate has parallel top and bottom edges, parallel inner and outer edges, and interior and exterior surfaces. First and second fingering assemblies include fingers fabricated of a flexible material. Each finger includes a terminal projection extending into the space between the support plates. The fingers may move into and out of the space between the support plates. First and second tubes are provided. Each tube is coupled to the inner edge of an associated plate. Each tube has circumferential recesses with C-shaped clips positioned within the circumferential recesses. In this manner the tubes are secured together. Also in this manner rotation of the tubes and support plates is allowed.

3 Claims, 3 Drawing Sheets

NOTE TOTE SYSTEM

RELATED APPLICATION

The present non-provisional patent application is based upon Provisional Patent Application No. 61/563,036 filed Nov. 23, 2011, the subject matter of which is incorporated herein by reference.

BACKGROUND OF THE INVENTION

Field of the Invention

The present invention relates to a note tote system and more particularly pertains to receiving and retaining and carrying loose papers in an organized manner and for selectively dispensing such received and retained and carried papers at the discretion of the user, the receiving and retaining and dispensing being done in a safe, reliable, convenient and economical manner.

SUMMARY OF THE INVENTION

In view of the disadvantages inherent in the known types of note systems of known designs and configurations now present in the prior art, the present invention provides an improved note tote system. As such, the general purpose of the present invention, which will be described subsequently in greater detail, is to provide a new and improved note tote system and method which has all the advantages of the prior art and none of the disadvantages.

To attain this, the present invention essentially comprises a note tote system. A space is provided between first and second plates. Each plate has parallel top and bottom edges, parallel inner and outer edges, and interior and exterior surfaces. First and second fingering assemblies include fingers. Each finger includes a terminal projection. The terminal projection extends into the space between the support plates. The fingers are fabricated of a flexible material. In this manner the fingers may move into and out of the space between the support plates. First and second tubes are provided. Each tube is coupled to the inner edge of an associated plate. Each tube has circumferential recesses with C-shaped clips positioned within the circumferential recesses. In this manner the tubes are secured together. Also in this manner rotation of the tubes and support plates is allowed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved note tote system which has all of the advantages of the prior art note systems of known designs and configurations and none of the disadvantages.

It is another object of the present invention to provide a new and improved note tote system which may be easily and efficiently manufactured and marketed.

It is further object of the present invention to provide a new and improved note tote system which is of durable and reliable constructions.

An even further object of the present invention is to provide a new and improved note tote system which is susceptible of a low cost of manufacture with regard to both materials and labor, and which accordingly is then susceptible of low prices of sale to the consuming public, thereby making such note tote system economically available to the buying public.

Even still another object of the present invention is to provide a note tote system for receiving and retaining and carrying loose papers in an organized manner and for selectively dispensing such received and retained and carried papers at the discretion of the user, the receiving and retaining and dispensing being done in a safe, reliable, convenient and economical manner.

Lastly, it is an object of the present invention to provide a new and improved note tote system. A space is provided between first and second plates. Each plate has parallel top and bottom edges, parallel inner and outer edges, and interior and exterior surfaces. First and second fingering assemblies include fingers. Each finger includes a terminal projection. The terminal projection extends into the space between the support plates. The fingers are fabricated of a flexible material. In this manner the fingers may move into and out of the space between the support plates. First and second tubes are provided. Each tube is coupled to the inner edge of an associated plate. Each tube has circumferential recesses with C-shaped clips positioned within the circumferential recesses. In this manner the tubes are secured together. Also in this manner rotation of the tubes and support plates is allowed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
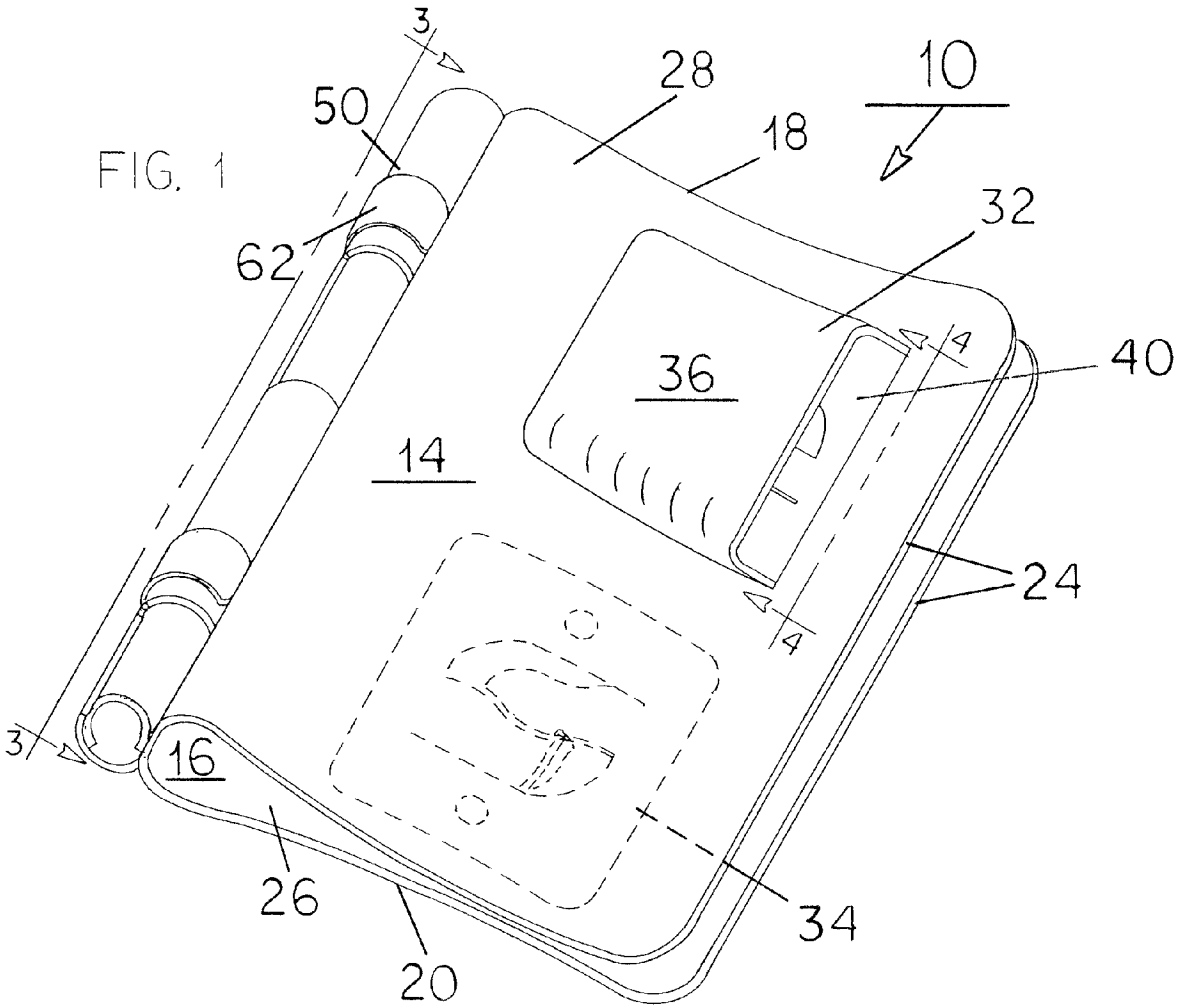
FIG. 1 is a perspective illustration of note tote system constructed in accordance with the principles of the present invention.
Figure 2:
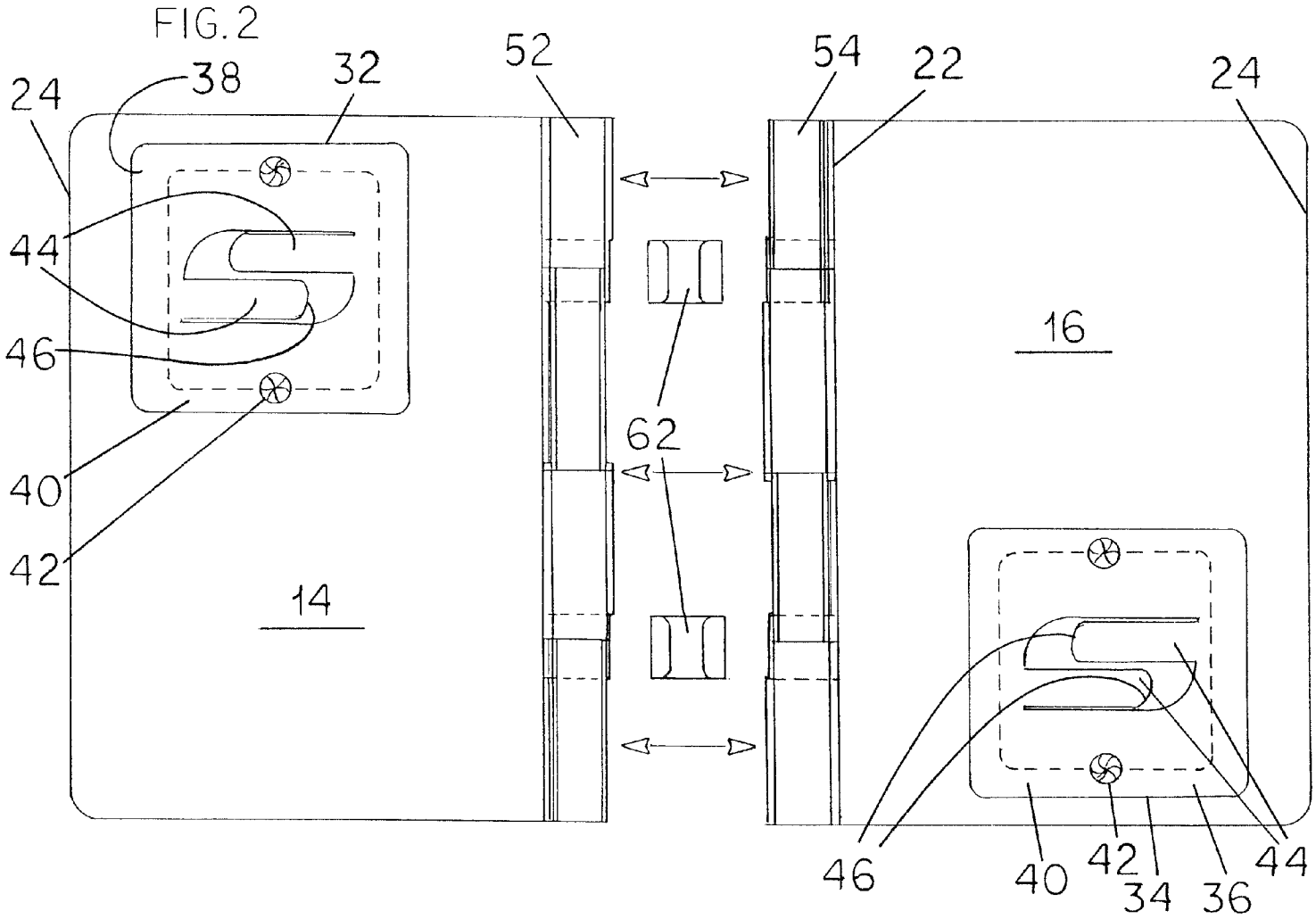
FIG. 2 is an exploded front elevational view of the system of FIG. 1.
Figure 3:
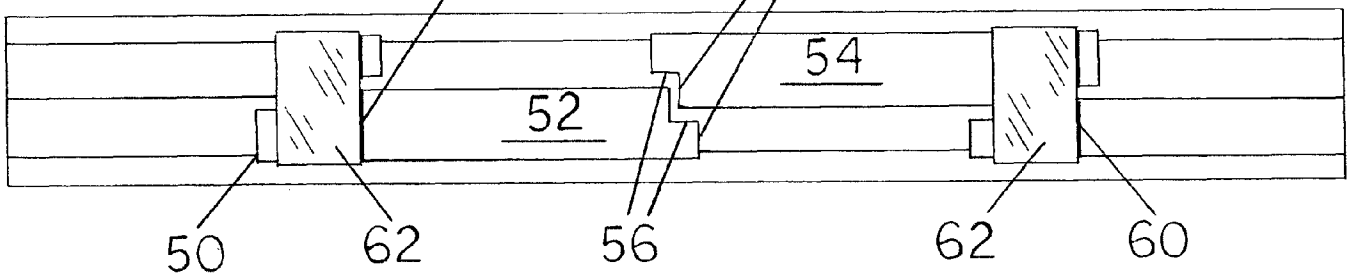
FIG. 3 is a bottom view of the system taken along line 3-3 of FIG. 1.
Figure 4:
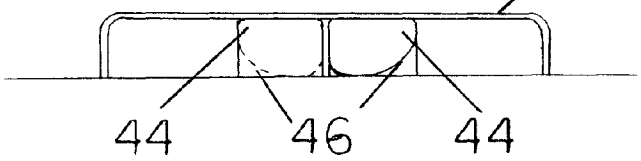
FIG. 4 is a cross sectional view taken along line 4-4 of FIG. 1.

With reference now to the drawings, and in particular to FIG. 1 thereof, the preferred embodiment of the new and improved note tote system embodying the principles and concepts of the present invention and generally designated by the reference numeral 10 will be described.

The present invention, the note tote system 10 is comprised of a plurality of components. Such components in their broadest context include first and second plates, first and second fingering assemblies and first and second tubes. Such components are individually configured and correlated with respect to each other so as to attain the desired objective.

First provided is a first support plate 14. A similarly configured second support plate 16 is provided. Each support plate has a generally S-shaped cross sectional configuration. Each support plate has a top edge 18. Each support plate has a parallel bottom edge 20. The top and bottom edges are separated by a height of 8.0 inches plus or minus 20 percent. Each support plate has an inner edge 22. Each support plate has a parallel outer edge 24. The inner and outer edges are separated by a width of 5.5 inches plus or minus 20 percent. Each support plate has a common surface area. Each support plate has an interior surface 26. Each support plate has an exterior surface 28. The interior and exterior surfaces are separated by a thickness of 0.125 inches plus or minus 20 percent. Each support plate has a convex cross sectional configuration. The convex cross sectional configuration is provided adjacent to the outer edge. In this manner a funnel is formed. Each support plate has a concave cross sectional configuration. The concave cross sectional configuration is provided adjacent to the inner edge. A paper receiving space is formed between the support plates. In the preferred embodiment, each support plate is fabricated of plastic polyvinyl chloride having limited flexibility. In other embodiments of the invention, different materials of limited flexibility may be substituted for the plastic polyvinyl chloride. The above described dimensions and materials are for the preferred embodiment. It should be understood that a wide range of dimensions and variety of materials could be used in other embodiments of the invention.

Further provided is a first fingering assembly 32. A similarly configured second fingering assembly 34 is provided. Each fingering assembly includes a rectangular raised platform 36. The rectangular raised platform projects exteriorly from the exterior surface of an associated support plate. Each raised platform has a surface area. The surface area of each raised platform is between 10 and 20 percent of the surface area of each support plate. The first fingering assembly is located adjacent to the top edge of the first support plate. The second fingering assembly is located adjacent to the bottom edge of the second support plate. Each raised platform has an exteriorly extending opening 38. The exteriorly extending opening faces the outer edge. Each raised platform includes a spring plate 40. The spring plate is provided within the raised platform. Weldments 42 are provided. The weldments couple each spring plate to an associated raised platform. Each spring plate has oppositely extending fingers 44. Each finger includes a terminal projection 46. The terminal projection is in a generally hemispherically configuration. The terminal projection extends into the space between the support plates. In the preferred embodiment, the fingers and projections are fabricated of a flexible plastic polyethylene. In other embodiments, other appropriate materials may be substituted for the flexible plastic polyethylene. In this manner the fingers and projections may move into and out of the space between the support plates.

Provided last is a hinge assembly 50. The hinge assembly includes a first tube 52. The hinge assembly includes a similarly configured second tube 54. Each tube is adhesively coupled to the inner edge of an associated support plate. Each tube has a centrally located L-shaped shoulder. Each L-shaped shoulder has an axial edge 56. The axial edge is adapted to limit the rotational movement of the tubes and support plate with respect to each other. Each L-shaped shoulder has a circumferential edge 58. The circumferential edge functions as a bearing surface during rotation of the tubes and support plates. Each tube has a circumferential recesses 60. Each tube has C-shaped clips 62. The C-shaped clips are fabricated of spring steel. The C-shaped clips are positioned within the circumferential recesses. In this manner the tubes are secured together. Also in this manner rotation of the tubes and support plates is allowed. The space between the support plates is adapted to receive a plurality of papers of various sizes. The papers are pushed by a user into the space between the support plates with the projections. The support plates contact and hold the received papers. The resilience of the projections is adapted to allow withdrawal of the held papers when pulled by a user from the space between the support plates.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A note tote system comprising:

first and second plates with a space there between, each plate having parallel top and bottom edges, parallel inner and outer edges, interior and exterior surfaces;

first and second fingering assemblies formed with fingers, each finger including a terminal projection extending into the space between the support plates, the fingers being fabricated of a flexible material for movement into and out of the space between the support plates;

first and second tubes, each tube coupled to the inner edge of an associated plate, each tube being formed with circumferential recesses with C-shaped clips positioned within the circumferential recesses for securing together the tubes while allowing rotation of the tubes and support plates; wherein the fingers include oppositely facing fingers coupled to each plate and parallel with the top and bottom edges.

2. A note tote system comprising: first and second plates with a space there between, each plate having parallel top and bottom edges, parallel inner and outer edges, interior and exterior surfaces; first and second fingering assemblies formed with fingers, each finger including a terminal projection extending into the space between the support plates, the fingers being fabricated of a flexible material for movement into and out of the space between the support plates; first and second tubes, each tube coupled to the inner edge of an associated plate, each tube being formed with circumferential recesses with C-shaped clips positioned within the circumferential recesses for securing together the tubes while allowing rotation of the tubes and support plates; and wherein each tube includes a centrally located L-shaped shoulder with an axial edge adapted to limit the rotational movement of the tubes and support plates with respect to each other, each L-shaped shoulder being formed with a circumferential edge to function as a bearing surface during rotation of the tubes and support plates.

3. A note tote system for receiving and retaining and carrying loose papers in an organized manner and for selectively dispensing such received and retained and carried papers at the discretion of the user, the receiving and retaining and dispensing being done in a safe, reliable, convenient and economical manner, the system comprising, in combination:

a first support plate and a similarly configured second support plate, each support plate having a generally S-shaped cross sectional configuration with a top edge and a parallel bottom edge separated by a height of 8.0 inches plus or minus 20 percent, each support plate having an inner edge and a parallel outer edge separated by a width of 5.5 inches plus or minus 20 percent, each support plate having a common surface area, each support plate having an interior surface and an exterior surface separated by a thickness of 0.125 inches plus or minus 20 percent, each support plate having a convex cross sectional configuration adjacent to the outer edge so as to form a funnel, each support plate having a concave cross sectional configuration adjacent to the inner edge, a paper receiving space formed between the support plates, each support plate being fabricated of plastic polyvinyl chloride with limited flexibility;

a first fingering assembly and a similarly configured second fingering assembly, each fingering assembly including a rectangular raised platform projecting exteriorly from the exterior surface of an associated support plate, each raised platform having a surface area between 10 and 20 percent of the surface area of each support plate, the first fingering assembly being located adjacent to the top edge of the first support plate, the second fingering assembly being located adjacent to the bottom edge of the second support plate, each raised platform having an exteriorly extending opening facing the outer edge, each raised platform including a spring plate within with weldments coupling each spring plate to an associated raised platform, each spring plate being formed with oppositely extending fingers, each finger including a terminal projection in a generally hemispherically configuration extending into the space between the support plates, the fingers and projections being fabricated of a flexible plastic polyethylene for movement into and out of the space between the support plates;

a hinge assembly formed of a first tube and a similarly configured second tube, each tube being adhesively coupled to the inner edge of an associated support plate, each tube being formed with a centrally located L-shaped shoulder with an axial edge adapted to limit the rotational movement of the tubes and support plates with respect to each other, each L-shaped shoulder being formed with a circumferential edge to function as a bearing surface during rotation of the tubes and support plates, each tube being formed with circumferential recesses, C-shaped clips fabricated of spring steel positioned within the circumferential recesses for securing together the tubes while allowing rotation of the tubes and support plates, the space between the support plates adapted to receive a plurality of papers of various sizes pushed by a user into the space between the support plates with the projections contacting and holding the received papers, the resilience of the projections adapted to allow withdrawal of the held papers when pulled by a user from the space between the support plates.

* * * * *